US006916223B2

(12) United States Patent
Gallitognotta et al.

(10) Patent No.: US 6,916,223 B2
(45) Date of Patent: Jul. 12, 2005

(54) DISCHARGE LAMPS USING HOLLOW CATHODES WITH INTEGRATED GETTERS AND METHODS FOR MANUFACTURING SAME

(75) Inventors: Alessandro Gallitognotta, Origgio (IT); Claudio Boffito, Rho (IT); Alessio Corazza, Como (IT)

(73) Assignee: SAES Getters S.p.A., Lainate (IT)

( * ) Notice: Subject to any disclaimer, the term of this patent is extended or adjusted under 35 U.S.C. 154(b) by 97 days.

(21) Appl. No.: 10/292,214

(22) Filed: Nov. 12, 2002

(65) Prior Publication Data

US 2003/0090202 A1 May 15, 2003

(30) Foreign Application Priority Data

Nov. 12, 2001 (IT) ..... MI2001A2389

(51) Int. Cl.[7] ..... H01J 61/09
(52) U.S. Cl. ..... 445/31; 445/29
(58) Field of Search ..... 313/549, 558, 313/554, 556; 445/29, 31, 4, 49–51, 55, 46; 204/499, 471

(56) References Cited

U.S. PATENT DOCUMENTS

| | | | | | |
|---|---|---|---|---|---|
| 2,295,694 | A | * | 9/1942 | Slack et al. | 313/561 |
| 3,203,901 | A | | 8/1965 | Della Porta | |
| 3,582,702 | A | * | 6/1971 | Almer | 313/558 |
| 3,786,296 | A | * | 1/1974 | Howorth | 313/54 |
| 4,306,887 | A | | 12/1981 | Barosi et al. | |
| 4,312,669 | A | | 1/1982 | Boffito et al. | |
| 4,437,038 | A | | 3/1984 | Link et al. | |
| 4,461,970 | A | | 7/1984 | Anderson | |
| 4,461,981 | A | * | 7/1984 | Saikatsu et al. | 315/246 |
| 4,578,618 | A | | 3/1986 | Zöchbauer | |
| 4,624,895 | A | * | 11/1986 | Nickola | 428/335 |
| 4,628,198 | A | | 12/1986 | Giorgi | |
| 4,698,550 | A | | 10/1987 | Kobayashi et al. | |
| 4,833,366 | A | | 5/1989 | Wu et al. | |
| 4,885,504 | A | | 12/1989 | Green | |
| 5,242,559 | A | * | 9/1993 | Giorgi | 204/491 |
| 5,825,127 | A | | 10/1998 | Weinhardt | |
| 5,856,726 | A | * | 1/1999 | Evans et al. | 313/491 |
| 5,961,750 | A | | 10/1999 | Boffito et al. | |
| 2003/0201388 | A1 | * | 10/2003 | Pusterla et al. | 250/282 |

FOREIGN PATENT DOCUMENTS

| | | | | |
|---|---|---|---|---|
| EP | 95104514.5 | | 10/1995 | |
| JP | 04149954 | | 5/1992 | |
| JP | 1998034095 | | 10/1998 | |
| JP | 2000-133201 | | 5/2000 | |
| JP | 2000133201 | A * | 5/2000 | H01J/61/067 |
| JP | 2001114437 | | 4/2001 | |
| JP | 2002-313277 | | 10/2002 | |
| JP | 2002-313278 | | 10/2002 | |
| WO | WO 97/49109 | | 12/1997 | |
| WO | WO 02/00959 | A1 | 1/2002 | |
| WO | WO 02/45112 | A1 | 6/2002 | |

OTHER PUBLICATIONS

European Patent Office, (International Patent No. PCT/IT 02/00711) International Searching Authority, International Search Report, Jan. 23, 2004, Milano, Italy.
European Patent Office, (International Patent No. PCT/IT 02/00711) International Searching Authority, International Search Report Jan. 10, 2003, Milano, Italy.

* cited by examiner

*Primary Examiner*—Joseph Williams
*Assistant Examiner*—Glenn Zimmerman
(74) *Attorney, Agent, or Firm*—Paul L. Hickman; Perkins Coie LLP

(57) ABSTRACT

A hollow cathode having at least a portion of the inner, outer or both surfaces coated with a layer of a getter material is described. Some methods for the production of the hollow cathode of the invention are also described, which include cathodic and electrophoretic deposition of the getter layer onto the hollow cathode.

20 Claims, 3 Drawing Sheets

DISCHARGE LAMPS USING HOLLOW CATHODES WITH INTEGRATED GETTERS AND METHODS FOR MANUFACTURING SAME

REFERENCE TO PRIORITY DOCUMENTS

This application claims priority under 35 U.S.C. § 119 to Italian Patent Application MI2001 A 002389 filed on Nov. 12, 2001, which is hereby incorporated by reference for all purposes.

BACKGROUND

Discharge lamps are commonly defined and known in the art as all the lamps in which the emission of a radiation, which can be visible or ultraviolet, takes place as a consequence of the electric discharge in a gaseous medium. The discharge is triggered and sustained by the potential difference applied to two electrodes placed at the opposed ends of the lamp.

The cathodes for lamps can have various shapes, for example filaments or spiral wound filaments, or other shapes. A particularly advantageous cathode shape is the hollow cathode. Hollow cathodes have generally the shape of a hollow cylinder that is open at the end facing the discharge zone, and closed at the opposite end. As is well known to those skilled in the art, one advantage given by the hollow cathodes with respect to other cathode shapes is their lower potential difference (of about 5%–10%) required to "light" the discharge Another advantage of the hollow cathode is a lower intensity of the "sputtering" phenomenon by the cathode, namely the emission of atoms or ions from the cathodic material that can deposit on adjacent parts, among which include the glass walls of the lamp, thus reducing the brilliancy of the lamp. Examples of lamps with hollow cathodes are described for instance in patents U.S. Pat. Nos. 4,437,038, 4,461,970, 4,578,618, 4,698,550, 4,833,366 and 4,885,504 as well as in the published Japan patent application 2000-133201, which are hereby incorporated by reference.

It is also known by those skilled in the art that in order to ensure a proper operation of these lamps throughout their lives, it is necessary to ensure the consistency of the mixtures forming the gaseous medium of the discharge. These mixtures are, in general, mainly formed by one or several rare gases, such as argon or neon, and in many cases some milligrams of mercury. The composition of these mixtures can vary from the desired one, because of both the impurities remaining in the lamp from the production process, and those released during time by the same materials forming the lamp or permeating inward from the walls thereof. Impurities present in these mixtures can damage the working of the lamp in various ways. For example, oxygen or oxygenated species can react with mercury to form HgO, thus removing the metal from its function. Hydrogen can cause discharge striking difficulties (and consequently lighting difficulties of the lamp) or change the operating electrical parameters of the lamp, increasing its energy consumption.

In order to eliminate these impurities it is known by those skilled in the art to introduce a getter material into the lamps. Getter materials have the function of fixing the impurities through a chemical reaction, thus removing them from the gaseous medium. Getter materials widely used for this purpose are the zirconium-aluminum alloys described in U.S. Pat. No. 3,203,901; the zirconium-iron alloys described in U.S. Pat. No. 4,306,887; the zirconium-vanadium-iron alloys described in U.S. Pat. No. 4,312,669; and the zirconium-cobalt-mischmetal alloy described in U.S. Pat. No. 5,961,750 (mischmetal is a mixture of rare earth metals). All four of these U.S. patents are hereby incorporated by reference. These getter materials are generally introduced in the lamps in the form of getter devices formed by powders of material that are fixed to a support. Usually, getter devices for lamps are formed by a cut-down size of a supporting metal strip, flat or variously folded, onto which the powder is fixed by rolling; an example of such a getter device for lamps is described in U.S. Pat. No. 5,825,127, which is hereby incorporated by reference.

As is generally known by those skilled in the art, in some cases the getter device is formed by a getter material pill simply inserted into the lamp. It is highly preferable when a getter is fixed to some constituting element of the lamp because a getter that is not fixed does not lie generally in the hot areas of the lamp, and so its gas-absorbing efficiency decreases. Further a getter device can interfere with the light emission. The device is accordingly almost always fixed (in general by spot welding), for instance to the cathodic support, whereas in some cases a suitable support is added to the lamp. In all cases, however, additional steps are required in the production process of the lamp. In addition, some lamps have an extremely reduced diameter, such as those used for backlighting the liquid crystal screens, which have diameters not larger than 2–3 millimeters. In a case with such a narrow diameter it is difficult to find a suitable arrangement of the getter device within the lamp, and the assembling operations for the device may become extremely difficult.

SUMMARY

The present invention overcomes the above-listed problems by teaching a hollow cathode with an integrated getter layer for discharge lamps, and also teaches some of the methods for manufacturing such a lamp. This is accomplished by providing in a first aspect a hollow cathode formed by a hollow cylindrical part open at a first end and closed at the opposed end, in which on at least an outer or inner portion of the cylindrical surface a layer of getter material is present. In a second aspect of the invention, the getter layer may be deposited on the hollow cathode by a number of methods including cathodic deposition and electrophoretic deposition. Other methods support the manufacture of such a getter-coated cathode as well as can be appreciated by those skilled in the art.

BRIEF DESCRIPTION OF THE DRAWINGS

The invention will be described below with reference to the drawings wherein.

DETAILED DESCRIPTION OF THE INVENTION

Figure 1:
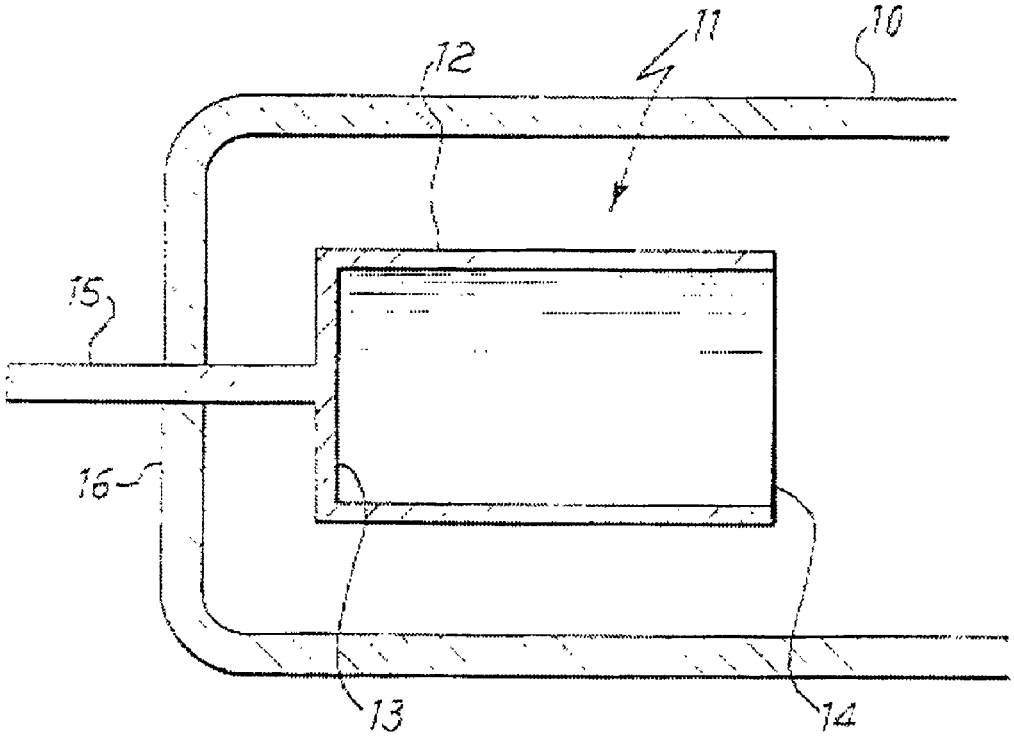
FIG. 1 shows the section of the end part of a discharge lamp having a hollow cathode not coated with getter material.

Referring now to FIG. 1, a section of the end part of a lamp 10 containing a hollow cathode 11 represented in its most general shape and without any coating formed of a getter layer is shown. The cathode is made of metal and is formed by a cylindrical hollow part 12 having a closed end 13 and an open end 14. At closed end 13 there is fixed a part 15 formed in general by a metallic wire; this part 15 is generally fixed to the closed end of lamp 16, for example, by inserting it in the glass when this is let softened by heat to allow the sealing of closed end of the lamp 16. Part 15 fulfills the double function of a support of cylindrical hollow part 12 and of an electric conductor for connecting cylindrical hollow part 12 to the outside power. Both cylindrical hollow part 12 and part 15 may form a single piece, but more generally they are two parts fixed to each other for example by heat seal or mechanically by compression of cylindrical hollow part 12 around part 15.

Figure 2:
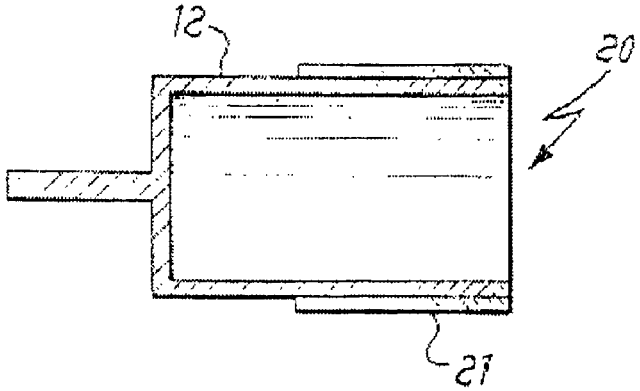
FIGS. 2 to 4 show the sections of various possible embodiments of the hollow cathode according to the invention.
Figure 3:
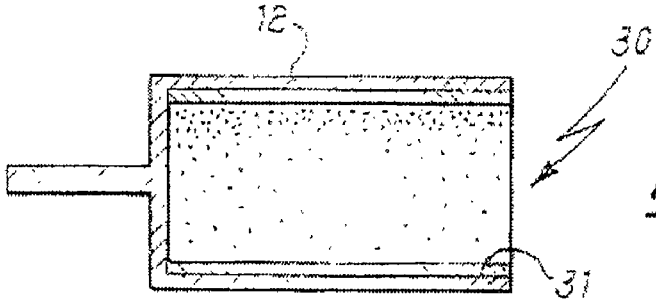
Figure 4:
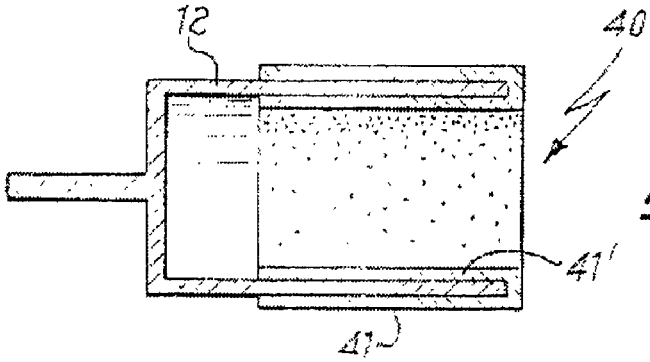

FIGS. 2 to 4 show different embodiments of inventive cathodes as embodied in the present invention, namely, hollow cathodes having at least a part of the surface coated with a getter layer. In particular, FIG. 2 shows a hollow cathode 20 wherein a getter layer 21 is only present on a part of outer surface of cylindrical hollow part 12. FIG. 3 shows a hollow cathode 30 wherein a getter layer 31 is only present on inner surface of the cylindrical hollow part 12. FIG. 4 shows a hollow cathode 40 wherein two getter layers 41, 41' are present both on a portion of outer surface and on a portion of inner surface of cylindrical hollow part 12.

As it will be apparent to people skilled in the art, although in the figures only some embodiments have been represented, the coatings of the two surfaces (inner and outer) of cylindrical hollow part 12 with a getter material may be total or partial. For example, in the case of FIG. 2, the getter layer 21 could totally coat the outer surface of cylindrical hollow part 12, or in the case of FIG. 4, a partial coating of inner surface and total coating of outer surface may be appropriate. Other combinations of coatings could occur as can be appreciated by those skilled in the art.

Cylindrical hollow part 12 is made in general of nickel, or, according to the teaching of Japan patent application 2000-133201, which is hereby incorporated by reference, it can be formed with refractory metals, such as tantalum, molybdenum or niobium, that show a reduced sputtering phenomenon.

The getter layer can be made of any one of the metals that are known to have a high reactivity with gases, which metals essentially are titanium, vanadium yttrium, zirconium, niobium, hafnium and tantalum. In a preferred embodiment the use of titanium and zirconium is used for gettering purposes. In an alternative embodiment, it is possible to use a getter alloy, which is in general an alloy based on zirconium or titanium combined with one or more elements that are selected among the transition metals and aluminum, such as, for instance, the alloys of previously named patents mentioned above, which have been incorporated by reference for the purposes of disclosing these getter materials.

The layer of getter material 21, 31, 41, or 41' can have a thickness between a few microns ($\mu$m) and some hundreds of microns, dependent on the technique used to produce it (which is discussed below) and according to the diameter of cylindrical hollow part 12. In the case of hollow cathodes in which cylindrical hollow part 12 has a diameter of about 1 millimeter, it is preferable that the thickness of the getter layer 21, 31, 41, or 41' is as small as possible, insofar as the getter material is enough to effectively fulfill the function of absorbing the gaseous impurities, as can be appreciated by those skilled in the art.

The layer of getter material does not alter the functionality of the cathode, as it was observed that these materials have work function values not exceeding those of the metals employed to produce cylindrical hollow part 12, and consequently the electronic emissive power of the cathode is not reduced.

A second aspect of the invention includes methods for producing hollow cathodes with a layer of getter material. According to a first embodiment of this second aspect, the layer of getter material can be produced by cathodic deposition, a technique better known in the field of thin layer production as "sputtering." As it is known by those skilled in the art, in sputtering the support to be coated (in this case a hollow cathode) and a generally cylindrical body (called the "target"), made of the material intended to form the layer, are placed in a suitable chamber. The chamber is evacuated and then a rare gas, usually argon, is backfilled at a pressure of about $10^{-2}$–$10^{-3}$ mbar. By applying a potential difference between the support and the target (the latter being kept at the cathodic potential) a plasma in argon is produced with formation of $Ar^+$ ions that are accelerated by the electric field toward the target, thus eroding it by impact; the particles removed from the target (ions, atoms or "clusters" of atoms) deposit on the available surfaces, among are which the ones of the support, forming a thin layer; for further details about principles and conditions of use, reference is made to the very abundant sectorial literature on sputtering. The obtaining of a getter layer formed by a single metal, for example titanium or zirconium, can be achieved with standard technical procedures.

However, the production of alloy layers with this technique may result in complications owing to the difficulties encountered in producing a target of getter material. These difficulties can be overcome by having recourse to the targets described in international patent application WO 02/00959 in the name of the applicant, which is hereby incorporated by reference for purposes of teaching this particular sputtering technique, which may be used in a preferred embodiment of the invention. In general most sputtering techniques are appropriately used when the getter layers no more than about 20 $\mu$m thick are to be produced, and hence are usually effective in the case of hollow cathodes that have narrow diameters.

Figure 5:
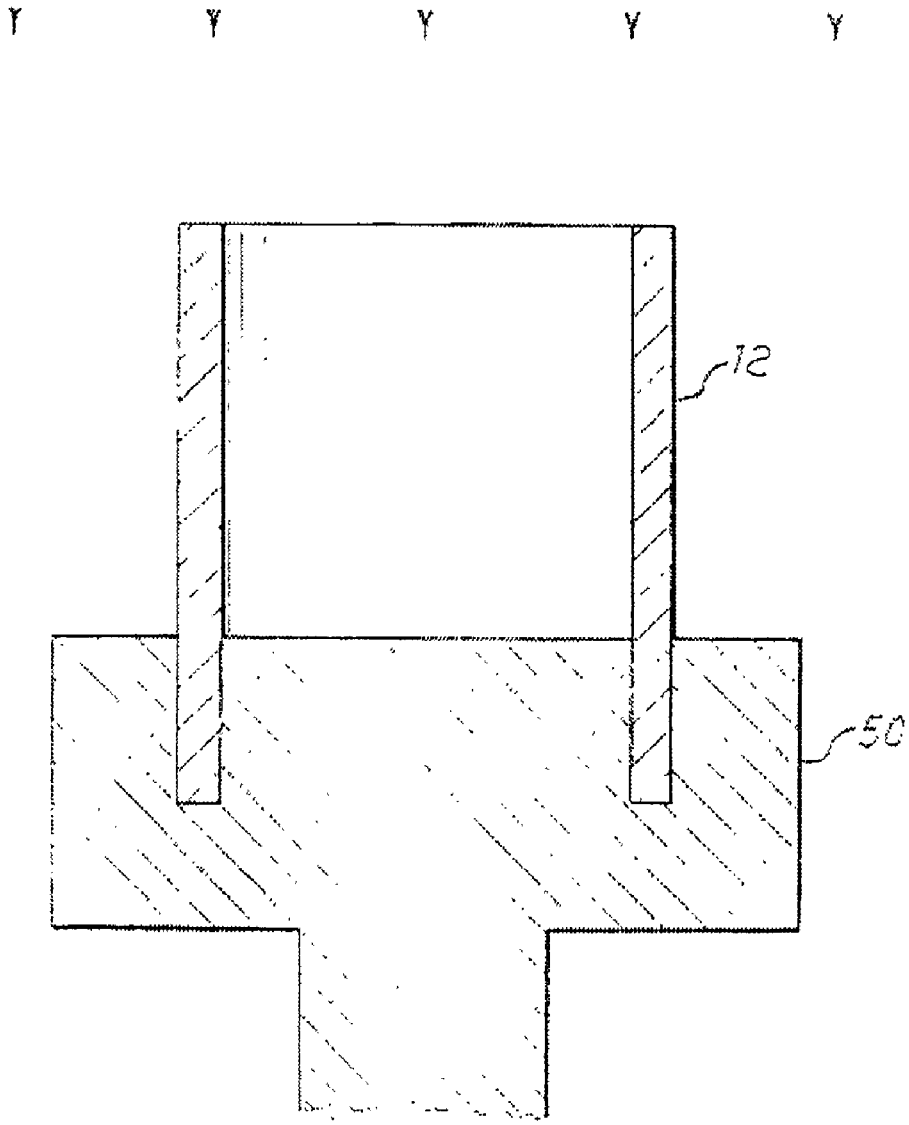
FIG. 5. shows a mode for obtaining a hollow cathode according to the invention.

Partial coatings of surfaces of cylindrical hollow part 12 can be obtained in this case by having recourse to masking, for instance by using, during the deposition, supporting elements of cylindrical hollow part 12 that are suitably shaped and selectively cover a portion of the surface thereof. An application example of this measure is shown in FIG. 5 regarding the production of a hollow cathode of type 40. In this case, during the deposition, cylindrical hollow part 12 is supported by an element 50, which masks a portion of both cylindrical surfaces (inner and outer) of said part; in the figure the arrows indicate the coming direction of the particles of material to be deposited. At the end of deposition, the region free of deposited getter is used for its fixing to part 15, whereas the region coated with getter is the one facing the lamp zone wherein the discharge occurs.

Another method for the production of a cathode coated with a getter layer according to the present invention is by electrophoresis. The production principles of layers of getter material by this way are exposed in U.S. Pat. No. 5,242,559 in the name of the applicant, which is hereby incorporated by reference for all purposes. In this case, a suspension of fine particles of getter material in a liquid is prepared, and the support to be coated (cylindrical hollow part 12) is dipped in the suspension. By suitably applying a potential difference between the support to be coated and a subsidiary electrode (it also dipped in the suspension), a transport of particles of getter material toward the support takes place. The obtained deposit is then stiffened through heat treatments. In this case the partial or complete coating of cylindrical hollow part 12 can be obtained by simply partially or totally dipping said cylindrical hollow part in the suspension. In such a case, too, it is further possible to selectively coat one of the two surfaces, inner or outer, by using a proper support of cylindrical hollow part 12, similarly to what was previously explained in the case of element 50 above. This technique is generally more appropriate in the production of thicker getter layers than those obtained by sputtering, with the possibility of easily and quickly forming layers having thickness up to some hundreds of $\mu$m.

Finally, when cylindrical hollow part 12 is formed of a refractory metal such as described in Japan application 2000-133201, the coating can be carried out by simple dipping in a molten bath with a composition corresponding to that of the getter metal or alloy to be deposited. Titanium and zirconium melt respectively, at about 1650° C. and 1850° C., and all previously cited zirconium-based alloys melt below 1500° C., whereas molybdenum melts at about 2600° C., niobium melts at about 2470° C. and tantalum at about 3000° C., and it is thus possible to dip, without any change, parts made of these metals in molten baths of getter metals or alloys. In this case, too, by totally or partially dipping cylindrical hollow part 12 in the bath, a partial or complete coating with the getter layer can be obtained.

As can be appreciated by those skilled in the art, the spirit and scope of the invention are not limited to the above examples. For example, getter materials may be deposited on the hollow cathode by other techniques that would be appropriate, such as arc-generated plasma deposition, ionic beam deposition and laser ablation. However, the scope of the invention should be defined by the following claims.

We claim:

1. A method for the production of a cathode, including the steps of:

forming a cylindrical hollow part, wherein said cylindrical hollow part is closed at a first end and open at the opposed end; and at least partially coating said cylindrical hollow part with a getter layer on the outer or inner portion of said cylindrical hollow part by the technique of cathodic deposition, wherein said coating step includes a masking step, and wherein said masking step includes covering said cylindrical hollow part with a suitably shaped supporting element.

2. The method as recited in claim 1, wherein said layer of getter material is formed with thickness less than 20 $\mu$m.

3. A method for production of a cathode, including the steps of:

forming a cylindrical hollow part, wherein said cylindrical hollow part is closed at a first end and open at the opposed end; and at least partially coating said cylindrical hollow part with a getter layer on the outer or inner portion of said cylindrical hollow part by the technique of electrophoretic deposition.

4. The method as recited in claim 3, wherein said coating step of one or both inner and outer surfaces occurs by partially dipping said cylindrical hollow part in a liquid suspension containing getter particles used for the deposition.

5. A method as recited in claim 4, wherein said cylindrical hollow part is made of tantalum, molybdenum or niobium, and said layer of getter material is formed by dipping said cylindrical hollow part in a molten bath of said getter metal or alloy of which said layer is to be made.

6. The method according to claim 5, wherein said coating of one or both inner and outer surfaces of said cylindrical hollow part occurs by partially dipping said cylindrical hollow part in said molten bath.

7. A method for the production of a cathode, including the steps of:

forming a cylindrical hollow part, wherein said cylindrical hollow part is closed at a first end and open at the opposed end; and a step for at least partially coating said cylindrical hollow part with a getter layer on the outer and inner portion of said cylindrical hollow part.

8. The method of claim 7, wherein said step for at least partially coating said cylindrical hollow part with a getter layer includes coating said cylindrical hollow part by the technique of cathodic deposition.

9. The method of claim 8, wherein said layer of getter material is formed with thickness less than 20 $\mu$m.

10. The method of claim 8, wherein said step for at least partially coating said cylindrical hollow part with a getter layer includes a masking step, wherein said masking includes covering said cylindrical hollow part with a suitably shaped supporting element.

11. The method of claim 7, wherein said step for at least partially coating said cylindrical hollow part with a getter layer includes coating said cylindrical hollow part by the technique of electrophoretic deposition.

12. The method of claim 11, wherein said step for at least partially coating said cylindrical hollow part with a getter layer includes partially dipping said cylindrical hollow part in a liquid suspension containing getter particles used for the deposition.

13. The method of claim 11, wherein said cylindrical hollow part is made of tantalum, molybdenum or niobium, further comprising dipping said cylindrical hollow part in a molten bath of said getter metal or alloy of which said layer of getter material is to be formed.

14. The method according to claim 11, further comprising dipping said cylindrical hollow part in a molten bath of said getter metal or alloy of which said layer of getter material is to be formed, wherein said step for at least partially coating said cylindrical hollow part with a getter layer includes coating at least part of both inner and outer surfaces of said cylindrical hollow part by partially dipping said cylindrical hollow part in said molten bath.

15. The method of claim 1, wherein said step for at least partially coating said cylindrical hollow part with a getter layer includes coating said cylindrical hollow part by the technique of electrophoretic deposition.

16. The method of claim 15, wherein said step for at least partially coating said cylindrical hollow part with a getter layer includes partially dipping said cylindrical hollow part in a liquid suspension containing getter particles used for the deposition.

17. The method of claim 15, wherein said cylindrical hollow part is made of a getter metal selected from the group consisting of: tantalum, molybdenum or niobium, further comprising dipping said cylindrical hollow part in a molten bath of said getter metal or alloy of which said layer of getter material is to be formed.

18. The method of claim 15, further comprising dipping said cylindrical hollow part in a molten bath of said getter metal or alloy of which said layer of getter material is to be formed.

19. The method of claim 18, wherein said step for at least partially coating said cylindrical hollow part with a getter layer includes coating at least part of both inner and outer surfaces of said cylindrical hollow part by partially dipping said cylindrical hollow part in said molten bath.

20. The method of claim 19, wherein said getter metal is selected from the group consisting of: titanium, vanadium, yttrium, zirconium, niobium, hafnium, and tantalum.

* * * * *